US012133622B2

(12) United States Patent
Zhang et al.

(10) Patent No.: US 12,133,622 B2
(45) Date of Patent: Nov. 5, 2024

(54) VACUUM CLEANER FLOOR BRUSH WITH HEIGHT-ADJUSTABLE SUCTION INLET

(71) Applicant: Jashen (Suzhou) Technology Co., Ltd, Suzhou (CN)

(72) Inventors: Qi Zhang, Suzhou (CN); Mingming Zhu, Suzhou (CN); Yongbi Chai, Suzhou (CN)

( * ) Notice: Subject to any disclaimer, the term of this patent is extended or adjusted under 35 U.S.C. 154(b) by 441 days.

(21) Appl. No.: 17/595,502

(22) PCT Filed: Apr. 24, 2020

(86) PCT No.: PCT/CN2020/086635
§ 371 (c)(1),
(2) Date: Nov. 17, 2021

(87) PCT Pub. No.: WO2020/238513
PCT Pub. Date: Dec. 3, 2020

(65) Prior Publication Data

US 2022/0313038 A1 Oct. 6, 2022

(30) Foreign Application Priority Data

May 24, 2019 (CN) ..... 201910443337.2

(51) Int. Cl.
*A47L 9/06* (2006.01)
*A46B 13/00* (2006.01)
(Continued)

(52) U.S. Cl.
CPC ..... *A47L 9/066* (2013.01); *A46B 13/001* (2013.01); *A46B 13/02* (2013.01); *A47L 9/0477* (2013.01); *A46B 2200/3033* (2013.01)

(58) Field of Classification Search
CPC . A47L 9/02; A47L 9/04; A47L 9/0477; A47L 9/0411; A47L 9/0416;
(Continued)

(56) References Cited

U.S. PATENT DOCUMENTS 4,909,669 A * 3/1990 Baker ..... F16L 1/123 138/172
2006/0277713 A1* 12/2006 Sandlin ..... A47L 9/0416 15/387
2022/0110500 A1* 4/2022 Shen ..... G05D 3/12

FOREIGN PATENT DOCUMENTS

CA 2008318 A1 * 1/1991
CN 109691933 A 4/2019
(Continued)

OTHER PUBLICATIONS

Matsushita Y, JP-4909669-B2, Apr. 4, 2012, translation (Year: 2012).*
ISR of PCT/CN2020/086635.

*Primary Examiner* — Katina N. Henson
(74) *Attorney, Agent, or Firm* — Hemisphere Law, PLLC; Zhigang Ma

(57) ABSTRACT

The present disclosure provides a vacuum cleaner floor brush with a height-adjustable suction inlet. The vacuum cleaner floor brush includes a floor brush main body, a rolling brush, and a rolling brush cover with an arc-shaped cross section; the rolling brush is fixedly mounted on a preset rolling brush chamber on the floor brush main body; the floor brush main body is provided with a suction inlet adjustment plate; an inner wall of the suction inlet adjustment plate is a cambered surface; a lengthwise direction of the suction inlet adjustment plate is parallel to an axial direction of the rolling brush; two opposite ends in a width direction of the suction inlet adjustment plate respectively extend towards the rolling brush cover and a bottom suction inlet of the floor brush main body; and the suction inlet adjustment plate can flip along a circumferential direction of the rolling brush. In the present disclosure, more than two kinds of different rolling brushes can be mounted on the same floor brush for use. When different rolling brushes are
(Continued)

used on different floors, the suction inlet adjustment plate can be adjusted up and down to make the height of the suction inlet change, so as to improve the cleanness of the floor brush.

11 Claims, 4 Drawing Sheets

(51) Int. Cl.
*A46B 13/02* (2006.01)
*A47L 9/04* (2006.01)

(58) Field of Classification Search
CPC .... A47L 9/0433; A47L 9/0444; A47L 9/0455; A47L 11/4011; A47L 13/22; A47L 13/42; A47L 2201/00; A47L 5/24; A47L 5/28; A47L 7/0061; A47L 9/009; A47L 9/0405; A47L 9/0427; A47L 9/0438; A47L 9/0488; A47L 9/0494; A47L 9/06; A47L 9/0653; A47L 9/066; A47L 9/0673; A47L 9/24
USPC ..... 15/387, 416, 328, 354, 383, 415.1
See application file for complete search history.

(56) References Cited

FOREIGN PATENT DOCUMENTS

| | | | |
|---|---|---|---|
| CN | 110101337 | A | 8/2019 |
| DE | 102017102466 | A1 | 8/2018 |
| JP | 2007252643 | A | 10/2007 |
| JP | 4909669 | B2 * | 4/2012 |

* cited by examiner

VACUUM CLEANER FLOOR BRUSH WITH HEIGHT-ADJUSTABLE SUCTION INLET

TECHNICAL FIELD

The present disclosure relates to the field of vacuum cleaners, in particular to a vacuum cleaner floor brush with a height-adjustable suction inlet.

BACKGROUND

A vacuum cleaner is cleaning equipment widely used in advanced human life and industrial production and has been developed for more than 100 years since its birth. The working principle of the vacuum cleaner is using a motor to drive blades to rotate at a high speed, generate negative air pressure in a sealed casing, and then sucking dust and debris through a floor brush connected to a dust suction pipe. A rolling brush is one of the main components of a floor brush assembly. A floor brush motor drives the rolling brush to rotate, thus bringing dust and debris on the floor to a suction inlet and sucking them into a dust cup of the vacuum cleaner, so as to achieve a cleaning and dust removal effect on the floor.

For most of the existing floor brushes, during removal and cleaning, a flocking rolling brush or a nap rolling brush is removed from the bottom or the left and right sides of the floor brush, or is removed, cleaned, and replaced from a surface cover and a front section of the floor brush.

The main disadvantages of the existing floor brush assembly are as follows:

1) The single rolling brush is provided on the floor brush, so different types of floors cannot be cleaned.

2) Both the flocking rolling brush and the nap rolling brush are equipped with the same floor brush. Due to different requirements for opening ways in the front ends of suction inlet seats, poor cleanliness is easily caused.

3) The floor brush is difficult to install, and some small parts are easy to lose.

SUMMARY

In view of this, the present disclosure provides a vacuum cleaner floor brush with a height-adjustable suction inlet. Since the height of its suction inlet is adjustable, the vacuum cleaner floor brush can be applicable to cleaning various floors.

To this end, the present disclosure provides a vacuum cleaner floor brush with a height-adjustable suction inlet. The vacuum cleaner floor brush includes a floor brush main body, a rolling brush, and a rolling brush cover with an arc-shaped cross section; the rolling brush is fixedly mounted on a preset rolling brush chamber on the floor brush main body; the floor brush main body is provided with a suction inlet adjustment plate; an inner wall of the suction inlet adjustment plate is a cambered surface; a lengthwise direction of the suction inlet adjustment plate is parallel to an axial direction of the rolling brush; two opposite ends in a width direction of the suction inlet adjustment plate respectively extend towards the rolling brush cover and a bottom suction inlet of the floor brush main body; and the suction inlet adjustment plate can flip along a circumferential direction of the rolling brush.

Further, two opposite ends in the lengthwise direction of the suction inlet adjustment plate are respectively provided with two rotatable connection plates which are respectively rotatably connected to two opposite sides of the floor brush main body.

Further, the two opposite sides of the floor brush main body are respectively provided with two rotating shaft components; and the two rotatable connection plates are respectively rotatably connected to the two rotating shaft components.

Further, the rotatable connection plates are circular connection plates.

Further, an inner wall of the suction inlet adjustment plate is fixedly connected with a sealing strip with an arc-shaped cross section; and the sealing strip extends along the lengthwise direction of the suction inlet adjustment plate.

Further, an outer wall of the suction inlet adjustment plate is a polygonal surface.

Further, the outer wall of the suction inlet adjustment plate is provided with a toggle component.

Further, the toggle component includes a plurality of protruding points fixedly arranged on the outer wall of the suction inlet adjustment plate.

Further, the rolling brush is a flocking rolling brush.

Further, the rolling brush is a nap rolling brush.

The present disclosure provides a vacuum cleaner floor brush with a height-adjustable suction inlet. The vacuum cleaner floor brush is mainly provided with a floor brush main body, a rolling brush, and a rolling brush cover with an arc-shaped cross section; the rolling brush is fixedly mounted on a preset rolling brush chamber on the floor brush main body; the floor brush main body is provided with a suction inlet adjustment plate; an inner wall of the suction inlet adjustment plate is a cambered surface; a lengthwise direction of the suction inlet adjustment plate is parallel to an axial direction of the rolling brush; two opposite ends in a width direction of the suction inlet adjustment plate respectively extend towards the rolling brush cover and a bottom suction inlet of the floor brush main body; and the suction inlet adjustment plate can flip along a circumferential direction of the rolling brush.

As an improvement, the suction inlet of the floor brush main body is provided with the suction inlet adjustment plate which can flip along the circumferential direction of the rolling brush. In this way, the height of the suction inlet can be adjusted by using the flip of the suction inlet adjustment plate, so as to adapt to the needs for sizes of the suction inlets of different rolling brushes. Therefore, two or more kinds of rolling brushes can be mounted on the same floor brush for use. When different rolling brushes are used on the floor, the suction inlet adjustment plate can be adjusted up and down to make the height of the suction inlet change, so as to improve the cleanness of the floor brush.

Therefore, compared to the existing art, the vacuum cleaner floor brush of the present disclosure has the following advantages:

1) One floor brush has multiple purposes and is high in cleanness.

2) The floor brush has a humanized design and is easy to operate and convenient to use.

3) The floor brush is easy to mount, and parts are difficult to lose.

BRIEF DESCRIPTION OF THE DRAWINGS

By reading the detailed description in the preferred specific implementation modes below, various other advantages and benefits will become clear to those of ordinary skill in the art. The accompanying drawings are only used for the purpose of illustrating the preferred implementation modes, and are not considered as a limitation to the present disclosure. Furthermore, throughout the drawings, the same reference numerals are used to denote the same components. In the drawings.

DETAILED DESCRIPTION OF THE EMBODIMENTS

Figure 1:
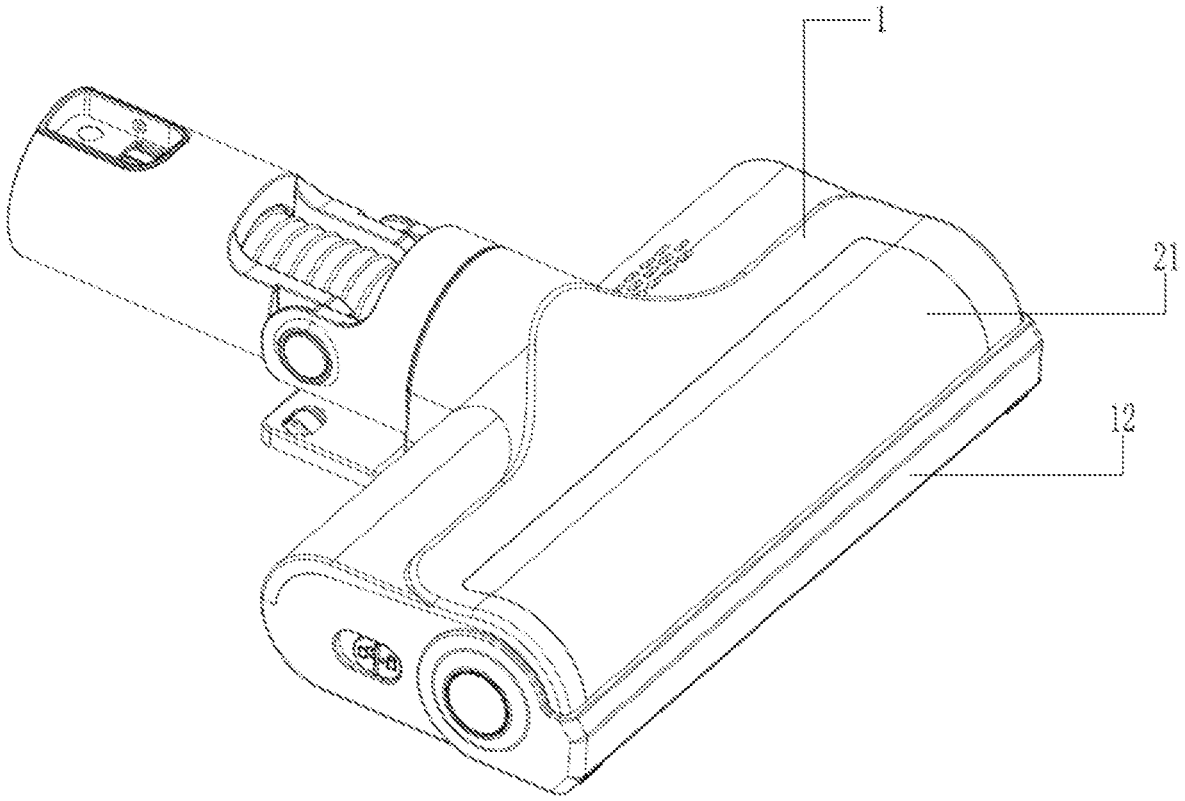
FIG. 1 is a three-dimensional diagram of a vacuum cleaner floor brush with a height-adjustable suction inlet provided by the embodiments in the present disclosure under a top angle.

Exemplary embodiments of the present disclosure will be described in more detail below with reference to the accompanying drawings. Although exemplary embodiments of the present disclosure are shown in the drawings, it should be understood that the present disclosure can be implemented in various forms and should not be limited by the embodiments set forth herein. On the contrary, these embodiments are provided to enable a more thorough understanding of the present disclosure and to fully deliver the scope of the present disclosure to those skilled in the art.

Embodiment I

Referring to FIG. 1 to FIG. 4, a vacuum cleaner floor brush with a height-adjustable suction inlet of Embodiment I of the present disclosure is illustrated. The vacuum cleaner floor brush includes a floor brush main body 1, a rolling brush 2, and a rolling brush cover 21 with an arc-shaped cross section. The rolling brush 2 is a nap rolling brush, which is fixedly mounted on a preset rolling brush chamber 11 on the floor brush main body 1; the floor brush main body 1 is provided with a suction inlet adjustment plate 12; an inner wall of the suction inlet adjustment plate 12 is a cambered surface; a lengthwise direction of the suction inlet adjustment plate 12 is parallel to an axial direction of the rolling brush 2; two opposite ends in a width direction of the suction inlet adjustment plate 12 respectively extend towards the rolling brush cover 21 and a bottom suction inlet 13 of the floor brush main body 1; and the suction inlet adjustment plate 12 can flip along a circumferential direction of the rolling brush 2.

Figure 2:
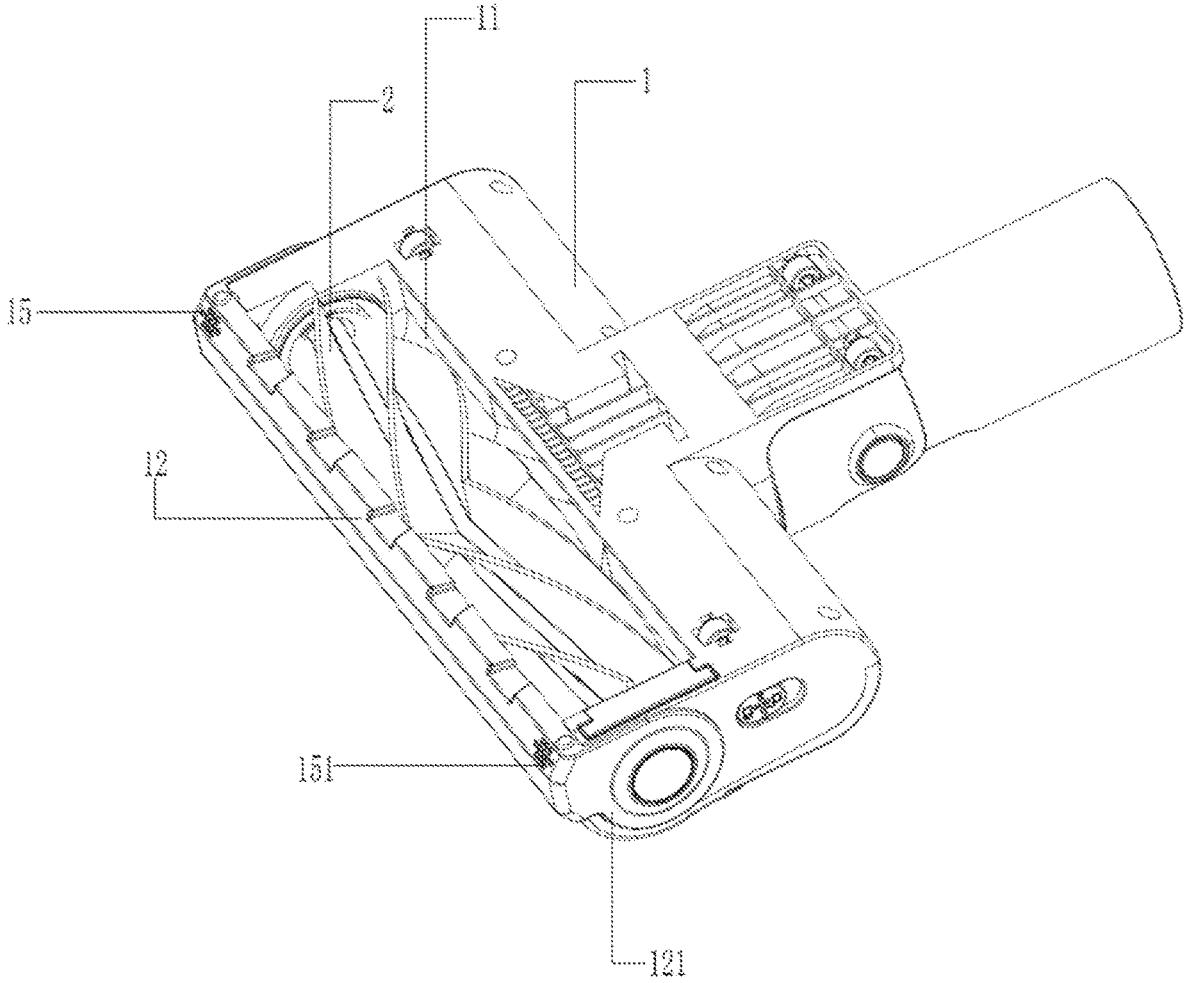
FIG. 2 is a three-dimensional diagram of a vacuum cleaner floor brush with a height-adjustable suction inlet provided by the embodiments in the present disclosure under a bottom angle.
Figure 3:
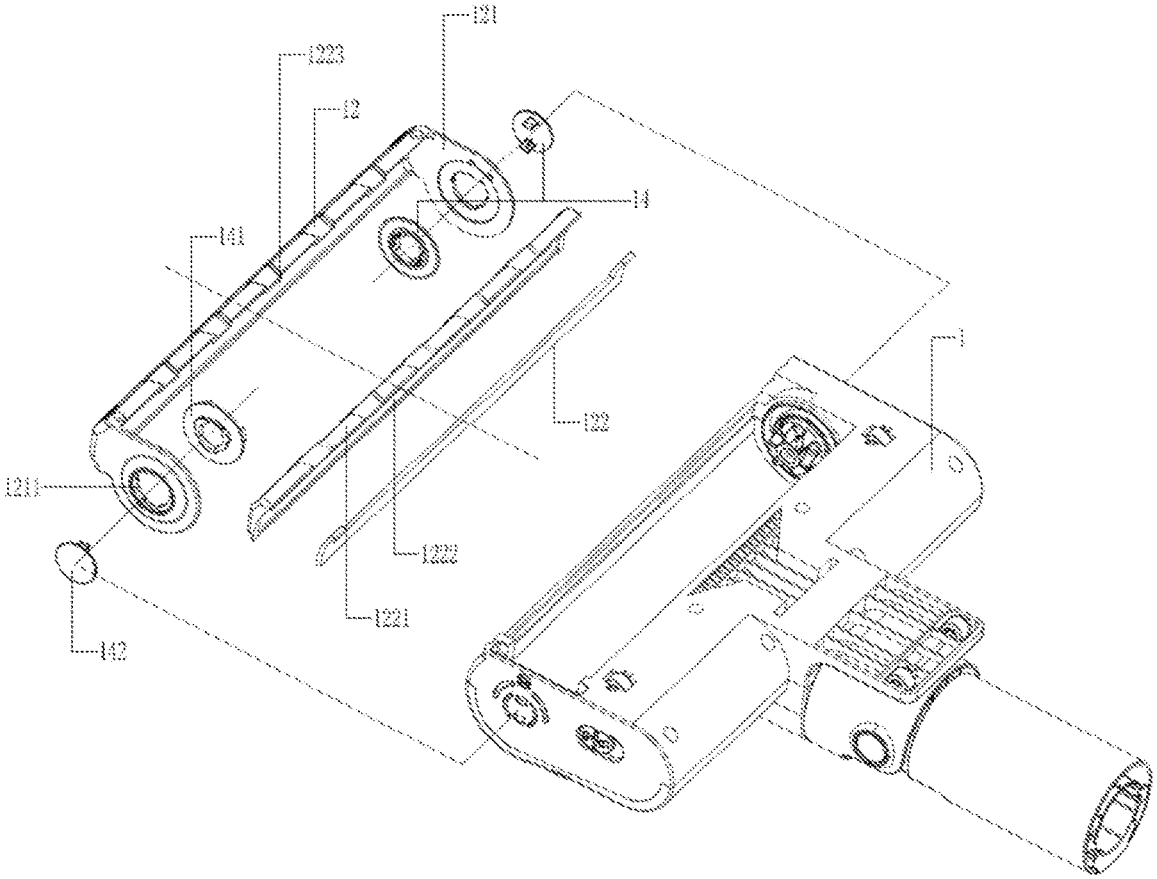
FIG. 3 is a structural exploded diagram of a vacuum cleaner floor brush with a height-adjustable suction inlet provided by the embodiments in the present disclosure.

Specifically, referring to FIG. 1 to FIG. 3, two opposite ends in the lengthwise direction of the suction inlet adjustment plate 12 are respectively provided with two rotatable connection plates 121 which are circular connection plates. The two opposite sides of the floor brush main body 1 are respectively provided with two rotating shaft components 14; and the two rotatable connection plates 121 are respectively rotatably connected to the two rotating shaft components 14. Each rotating shaft component 14 includes a rotating shaft sleeve 141 and an end cover 142. The rotating shaft sleeve 141 is sleeved on a rotating shaft of a side surface of the floor brush main body, and a circular assembling hole 1211 is formed in each rotatable connection plate 121. The rotating shaft sleeve 141 and the end cover 142 are respectively assembled on the inner side and the outer side of the circular assembling hole 1211. By means of the above structural arrangement, the suction inlet adjustment plate can flip along the circumferential direction of the rolling brush.

Figure 4:
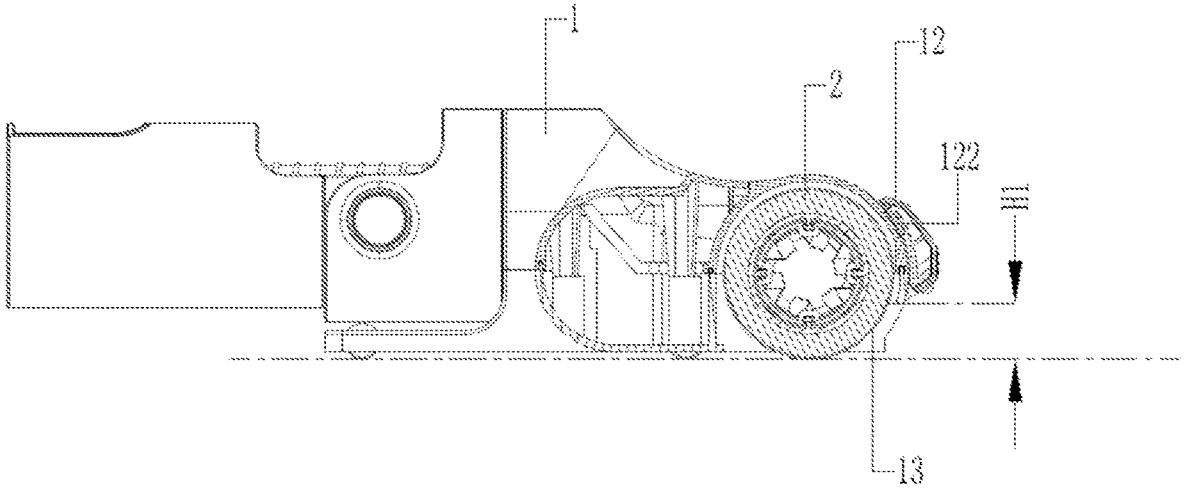
FIG. 4 is a schematic diagram of adjustment of the height of a suction inlet when a vacuum cleaner floor brush with a height-adjustable suction inlet provided by the embodiments in the present disclosure is applicable to a nap rolling brush.

Referring to FIG. 4, the nap rolling brush is mounted when dust and micro particulate matters on a smooth floor are cleaned, and the suction inlet adjustment plate is toggled up by 5 to 15 MM (such as H1 in FIG. 4) to enlarge an air feed area of the suction inlet of the nap rolling brush, thus improving the cleanness.

Embodiment II

Figure 5:
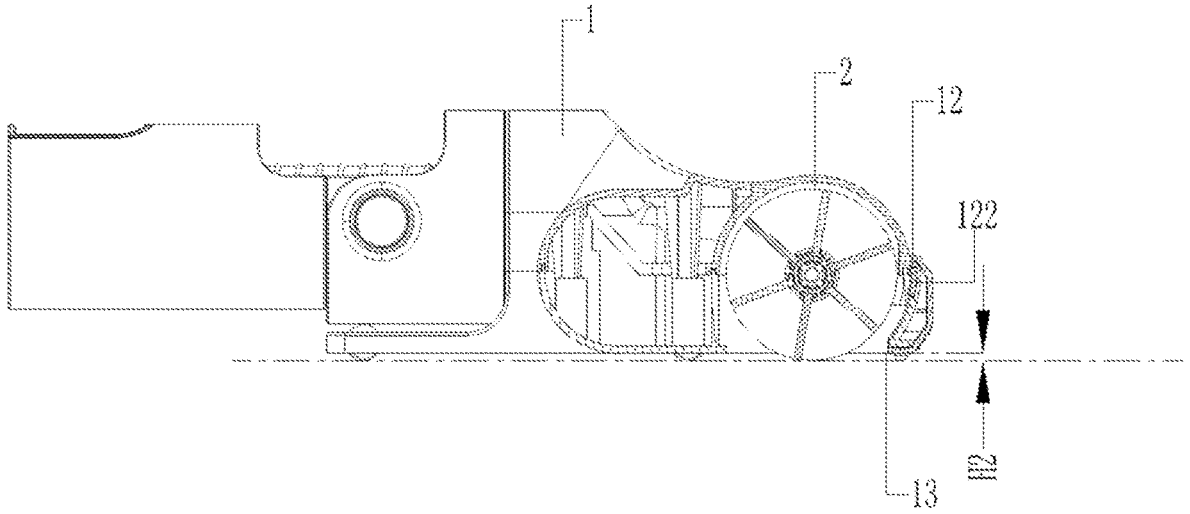
FIG. 5 is a schematic diagram of adjustment of the height of a suction inlet when a vacuum cleaner floor brush with a height-adjustable suction inlet provided by the embodiments in the present disclosure is applicable to a flocking rolling brush.

Referring to FIG. 5, a vacuum cleaner floor brush with a height-adjustable suction inlet provided by Embodiment II of the present disclosure is illustrated. Others are the same as those of Embodiment I while a difference is that the rolling brush 2 is a flocking rolling brush used for cleaning dust and particulate matters on a carpet, a smooth floor, and other floors. Meanwhile, the suction inlet adjustment plate is reset to 2-3.5 MM (such as H2 in FIG. 5) to increase the air feed vacuum degree of a suction nozzle of the flocking rolling brush, thus improving the cleanness.

Embodiment III

Referring to FIG. 1 to FIG. 5, a vacuum cleaner floor brush with a height-adjustable suction inlet provided by Embodiment III of the present disclosure is illustrated. The following improvements are further made on the basis of the above embodiments: An inner wall of the suction inlet adjustment plate 12 is fixedly connected with a sealing strip 122 with an arc-shaped cross section. The sealing strip 122 extends along the lengthwise direction of the suction inlet adjustment plate 12. Specifically, the sealing strip 122 is mounted in a mounting bin 1222 in a sealing strip mounting shell 1221. The sealing strip mounting shell 1221 is fixedly mounted in a mounting cavity 1223 in the suction inlet adjustment plate 12. By means of the above structural arrangement, an air sealing effect on the suction inlet can be achieved.

Embodiment IV

Referring to FIG. 1 to FIG. 5, a vacuum cleaner floor brush with a height-adjustable suction inlet provided by Embodiment IV of the present disclosure is illustrated. The following improvements are further made on the basis of the above embodiments: An outer wall of the suction inlet adjustment plate 12 is a polygonal surface, which is provided with a toggle component 15. The toggle component 15 includes a plurality of protruding points 151 fixedly arranged on the outer wall of the suction inlet adjustment plate 12. The protruding points 151 may specifically be circular protruding points. By means of the above structural arrangement, the suction inlet adjustment plate can be manually toggled conveniently to adjust the height of the suction inlet.

Obviously, those skilled in the art can make various changes and modifications to the present disclosure without departing from the spirit and scope of the present disclosure. Therefore, if these changes and transformations of the present disclosure fall within the scope of the claims of the present disclosure and equivalent technologies of the present disclosure, the present disclosure is intended to include these changes and transformations.

What is claimed is:

1. A vacuum cleaner floor brush with a height-adjustable suction inlet, wherein the vacuum cleaner floor brush comprises a floor brush main body (1), a rolling brush (2), and a rolling brush cover (21); the rolling brush cover (21) has an arc-shaped cross section; the rolling brush (2) is fixedly mounted on a preset rolling brush chamber (11) on the floor brush main body (1); the floor brush main body (1) is provided with a suction inlet adjustment plate (12); an inner wall of the suction inlet adjustment plate (12) is a cambered surface; a lengthwise direction of the suction inlet adjustment plate (12) is parallel to an axial direction of the rolling brush (2); two opposite ends in a width direction of the suction inlet adjustment plate (12) respectively extend towards the rolling brush cover (21) and a bottom suction inlet (13) of the floor brush main body (1); and the suction inlet adjustment plate (12) is capable of flipping along a circumferential direction of the rolling brush (2); wherein a sealing strip (122) with an arc-shaped cross section is fixedly connected to the inner wall of the suction inlet adjustment plate (12); and the sealing strip (122) extends along the lengthwise direction of the suction inlet adjustment plate (12).

2. The vacuum cleaner floor brush with the height-adjustable suction inlet according to claim 1, wherein two opposite ends in the lengthwise direction of the suction inlet adjustment plate (12) are respectively provided with two rotatable connection plates (121) which are respectively rotatably connected to two opposite sides of the floor brush main body (1).

3. The vacuum cleaner floor brush with the height-adjustable suction inlet according to claim 2, wherein the two opposite sides of the floor brush main body (1) are respectively provided with two rotating shaft components (14); and the two rotatable connection plates (121) are respectively rotatably connected to the two rotating shaft components (14).

4. The vacuum cleaner floor brush with the height-adjustable suction inlet according to claim 2, wherein the rotatable connection plates (121) are circular connection plates.

5. The vacuum cleaner floor brush with the height-adjustable suction inlet according to claim 1, wherein an outer wall of the suction inlet adjustment plate (12) is a polygonal surface.

6. The vacuum cleaner floor brush with the height-adjustable suction inlet according to claim 5, wherein the outer wall of the suction inlet adjustment plate (12) is provided with a toggle component (15).

7. The vacuum cleaner floor brush with the height-adjustable suction inlet according to claim 1, wherein the outer wall of the suction inlet adjustment plate (12) is provided with a toggle component (15).

8. The vacuum cleaner floor brush with the height-adjustable suction inlet according to claim 7, wherein the toggle component (15) comprises a plurality of protruding points (151) fixedly arranged on the outer wall of the suction inlet adjustment plate (12).

9. The vacuum cleaner floor brush with the height-adjustable suction inlet according to claim 1, wherein the rolling brush (2) is a flocking rolling brush.

10. The vacuum cleaner floor brush with the height-adjustable suction inlet according to claim 1, wherein the rolling brush (2) is a nap rolling brush.

11. The vacuum cleaner floor brush with the height-adjustable suction inlet according to claim 3, wherein the rotatable connection plates (121) are circular connection plates.

* * * * *